US010177481B1

(12) United States Patent
Hung et al.

(10) Patent No.: US 10,177,481 B1
(45) Date of Patent: Jan. 8, 2019

(54) ELECTRICAL CONNECTOR AND ELECTRICAL CONNECTOR ASSEMBLY WITH THE SAME

(71) Applicant: ALLTOP ELECTRONICS (SUZHOU) LTD., Taicang, JiangSu Province (CN)

(72) Inventors: Yung-Chih Hung, New Taipei (TW); Wang-I Yu, New Taipei (TW)

(73) Assignee: ALLTOP ELECTRONICS (SUZHOU) LTD., Taicang, Jiangsu Province (CN)

( * ) Notice: Subject to any disclaimer, the term of this patent is extended or adjusted under 35 U.S.C. 154(b) by 0 days.

(21) Appl. No.: 15/811,968

(22) Filed: Nov. 14, 2017

(30) Foreign Application Priority Data

Jul. 3, 2017 (CN) ..... 2017 1 0531263

(51) Int. Cl.
*H01R 13/428* (2006.01)
*H01R 13/436* (2006.01)
*H01R 4/18* (2006.01)

(52) U.S. Cl.
CPC ..... *H01R 13/4367* (2013.01); *H01R 4/185* (2013.01); *H01R 13/428* (2013.01); *H01R 13/4362* (2013.01)

(58) Field of Classification Search
CPC ..... H01R 13/4362; H01R 13/4361; H01R 13/4367; H01R 13/428; H01R 4/185
USPC ..... 439/752, 748, 746
See application file for complete search history.

(56) References Cited

U.S. PATENT DOCUMENTS 4,867,711 A * 9/1989 Yuasa ..... H01R 13/4362 439/744
5,066,252 A * 11/1991 Kato ..... H01R 13/4362 439/595
5,224,883 A * 7/1993 Yamamoto ..... H01R 13/4368 439/595
5,326,287 A * 7/1994 Hamakita ..... H01R 13/4362 439/595
5,356,302 A * 10/1994 Inoue ..... H01R 13/4361 439/189

(Continued)

FOREIGN PATENT DOCUMENTS

CN 102299442 B 7/2013
CN 104253340 B 4/2017

(Continued)

*Primary Examiner* — Gary F Paumen
(74) *Attorney, Agent, or Firm* — Cheng-Ju Chiang

(57) ABSTRACT

An electrical connector includes an insulative housing having a plurality of contact-receiving passageways extending through thereof along a front-and-back direction, a plurality of contacts inserted into the corresponding contact-receiving passageways along a rear-to-front direction and a limiting member assembled to the insulative housing. The contacts includes at least one row arranged along a transverse direction, and each contact defines a contacting part contacting with a complementary contact and a crimping portion connected with a wire. The insulative housing defines a positioning slot on one side thereof along a height direction, and the positioning slot extends along a transverse direction, the limiting member is inserted and retained in the positioning slot for locking the plurality of contacts simultaneously.

16 Claims, 19 Drawing Sheets

(56) References Cited

U.S. PATENT DOCUMENTS

| | | | | |
|---|---|---|---|---|
| 5,632,536 | A * | 5/1997 | Kitamura | H01R 13/4362 439/595 |
| 5,848,919 | A * | 12/1998 | Nagano | H01R 13/4362 439/752 |
| 5,890,935 | A | 4/1999 | Pill | |
| 6,183,312 | B1 * | 2/2001 | Yamamoto | H01R 13/432 439/746 |
| 7,828,607 | B2 * | 11/2010 | Kojima | H01R 13/4362 439/595 |
| 9,634,420 | B2 * | 4/2017 | Shindo | H01R 13/42 |
| 9,922,755 | B2 * | 3/2018 | Matsui | H01B 11/125 |
| 2001/0003689 | A1 * | 6/2001 | Kim | H01R 13/4226 439/752 |
| 2002/0193012 | A1 * | 12/2002 | Mase | H01R 13/4223 439/752 |
| 2003/0060075 | A1 * | 3/2003 | Nakamura | H01R 13/4223 439/345 |
| 2007/0281555 | A1 * | 12/2007 | Suemitsu | H01R 13/4362 439/752 |
| 2008/0268693 | A1 * | 10/2008 | Nakamura | H01R 13/4362 439/347 |
| 2009/0142958 | A1 * | 6/2009 | Matsumura | H01R 13/4362 439/595 |
| 2016/0072212 | A1 * | 3/2016 | Shindo | H01R 13/42 439/744 |
| 2017/0294731 | A1 * | 10/2017 | Leonhardt | H01R 4/184 |

FOREIGN PATENT DOCUMENTS

| | | | |
|---|---|---|---|
| TW | 201533992 | A | 9/2015 |
| TW | 201635651 | A | 10/2016 |

* cited by examiner

ELECTRICAL CONNECTOR AND ELECTRICAL CONNECTOR ASSEMBLY WITH THE SAME

BACKGROUND OF THE INVENTION

1. Field of the Invention

The present invention relates to an electrical connector, and more particularly to an electrical connector having a better structural efficiency and retention and an electrical connector assembly with the same.

2. Description of Related Art

A traditional electrical connector used for power transmission mainly comprises at least one contact and an insulative housing holding the contact in isolation from others. However the contact in the traditional electrical connector is retained in the insulative housing via a barb thereof, and the insulative housing defines a locking slot for latching with the barb, thus the insulative housing has a vulnerable structure, and there may be a risk of misinsertion when mating with a complementary connector.

Hence, it is desired to provide an electrical connector to overcome the problems mentioned above.

BRIEF SUMMARY OF THE INVENTION

Accordingly, an object of the present invention is to provide an electrical connector having a better structural efficiency and retention and an electrical connector assembly with the same.

The present invention is directed to an electrical connector comprising an insulative housing having a plurality of contact-receiving passageways extending through thereof along a front-and-back direction, a plurality of contacts inserted into the corresponding contact-receiving passageways along a rear-to-front direction and a limiting member assembled to the insulative housing. The contacts includes at least one row arranged along a transverse direction, and each contact defines a contacting part contacting with a complementary contact and a crimping portion connected with a wire. The insulative housing defines a positioning slot on one side thereof along a height direction, and the positioning slot extends along a transverse direction, the limiting member is inserted and retained in the positioning slot for locking the plurality of contacts simultaneously.

Other objects, advantages and novel features of the invention will become more apparent from the following detailed description of the present embodiment when taken in conjunction with the accompanying drawings.

DETAILED DESCRIPTION OF THE PREFERRED EMBODYMENT

Figure 1:
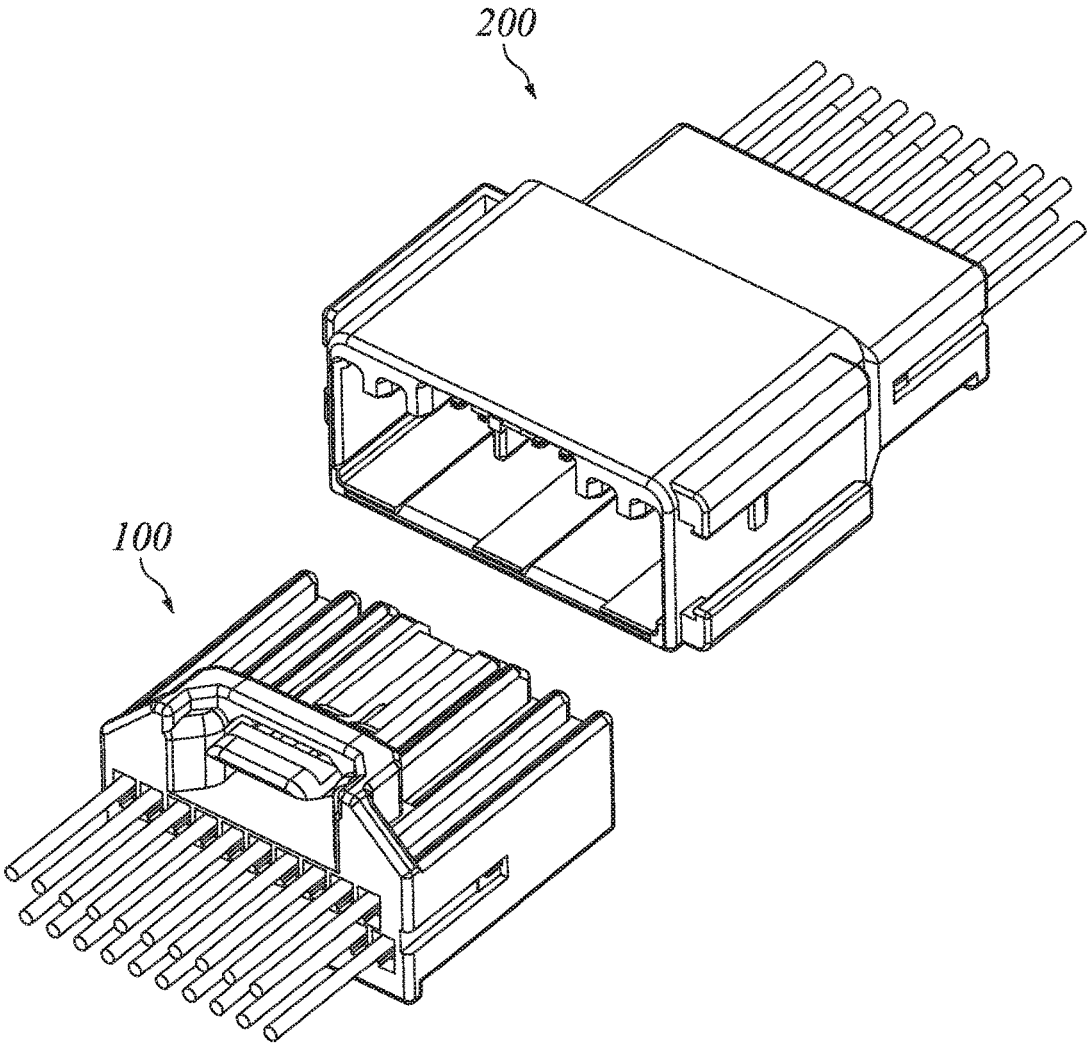
FIG. 1 is a perspective view of an electrical connector assembly in accordance with the present invention.
Figure 2:
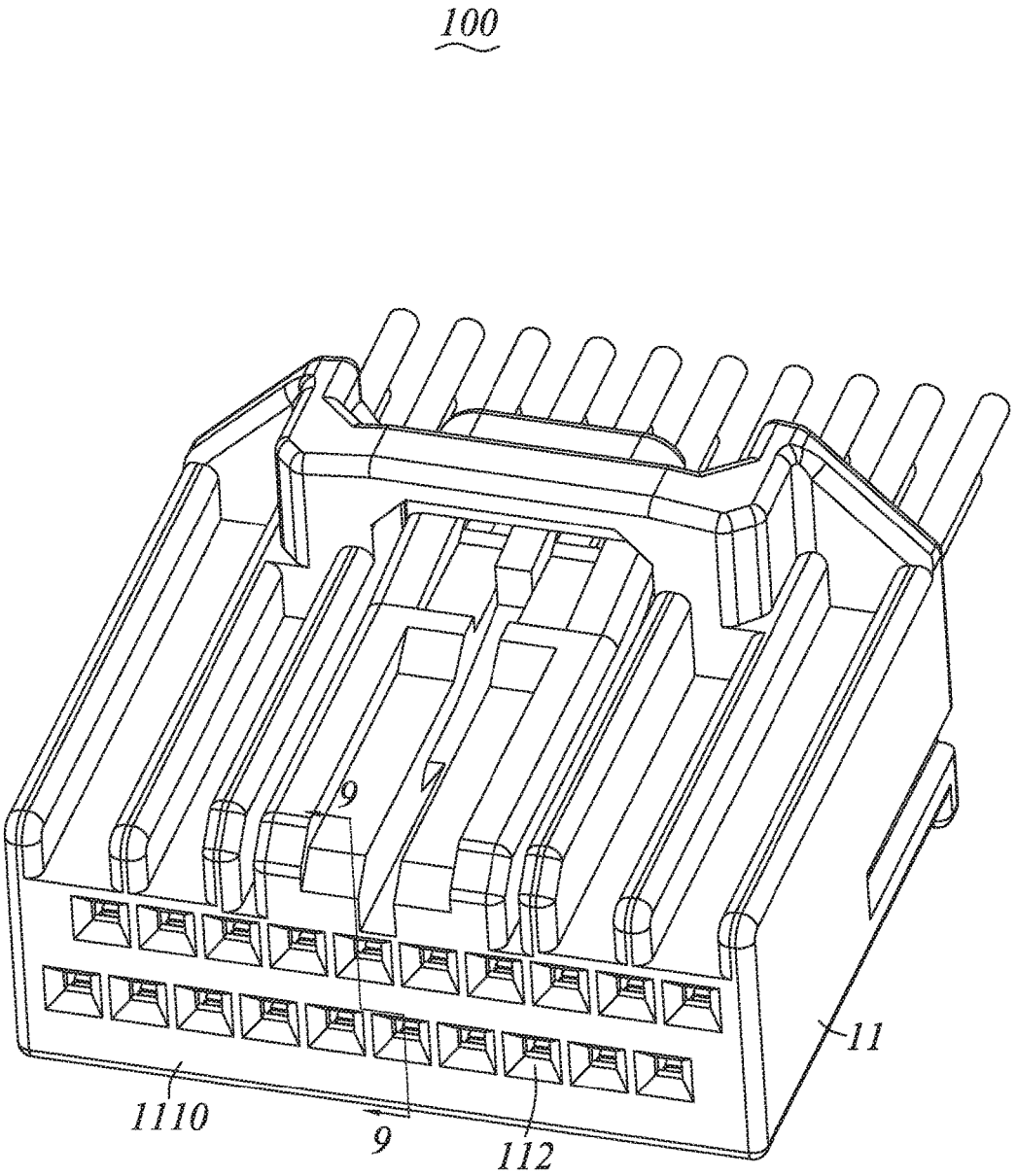
FIG. 2 is a perspective view of a receptacle connector of the electrical connector assembly shown in FIG. 1.

Reference will be made to the drawing figures to describe the present invention in detail, wherein depicted elements are not necessarily shown to scale and wherein like of similar elements are designated by same or similar reference numeral through the several views and same or similar terminology.

Figure 19:
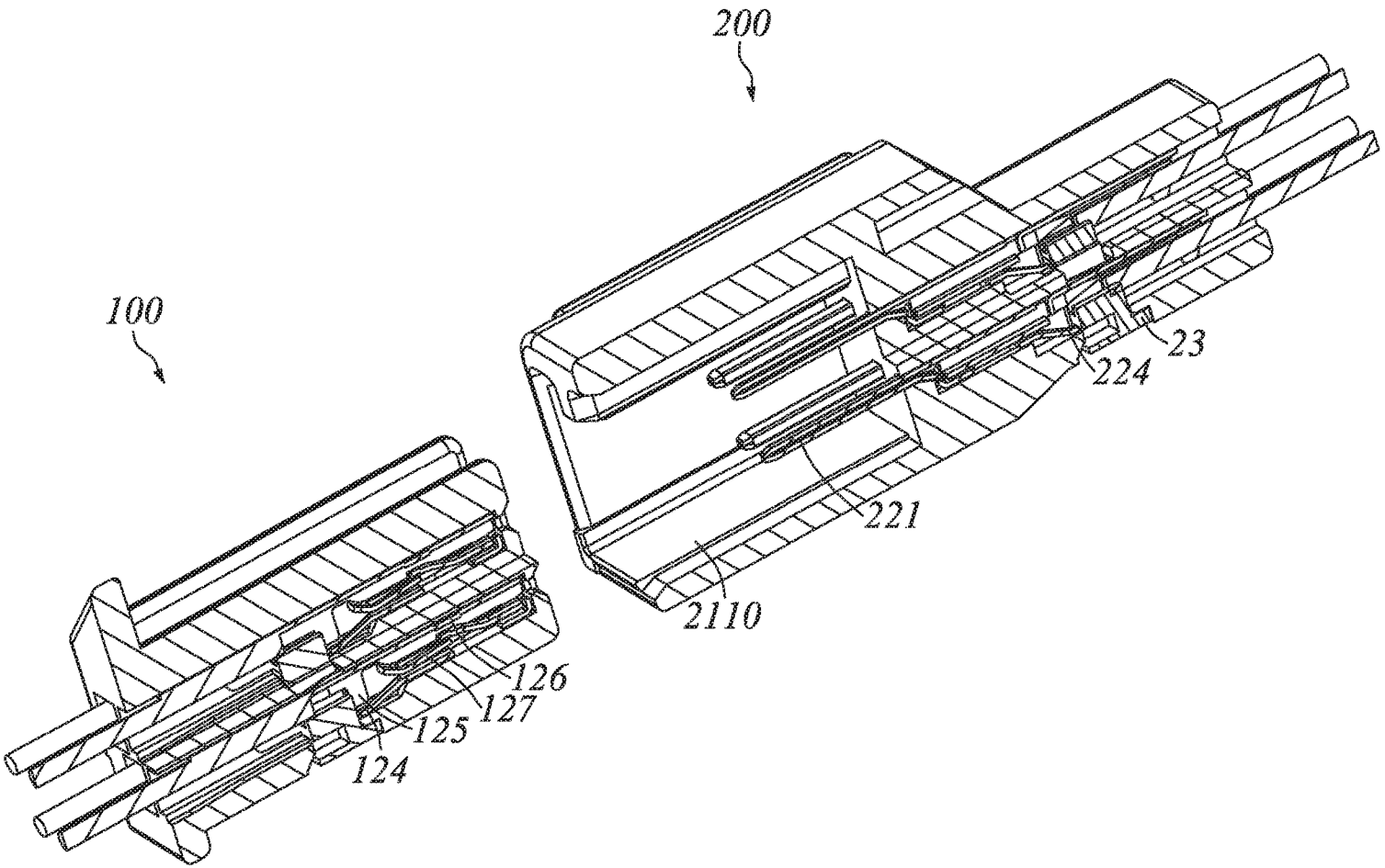
FIG. 19 is a cross-section view of FIG. 1.
Figure 20:
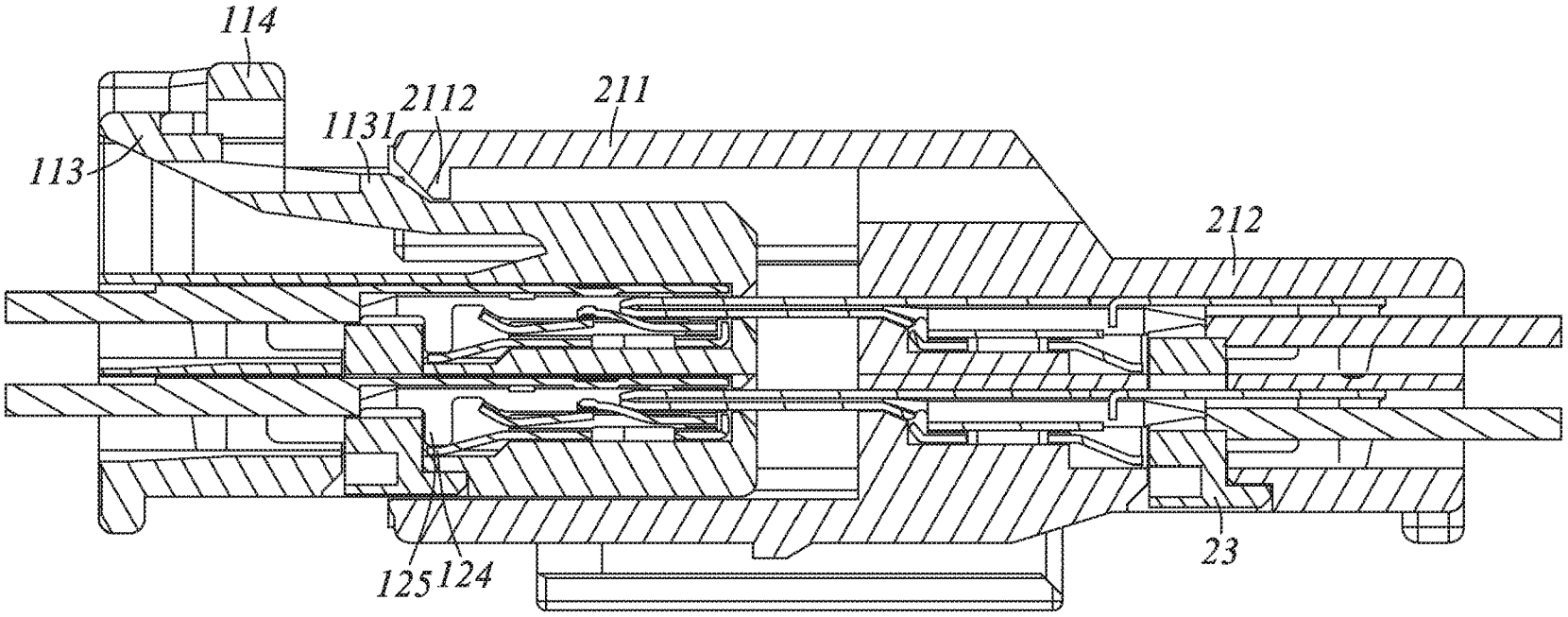
FIG. 20 is a cross-section view of the electrical connector assembly of FIG. 1 when the plug connector partially inserted into but unlocked with the receptacle connector.

FIGS. 1, 19 and 20 illustrate an electrical connector assembly of the present invention, and the electrical connector assembly comprises a receptacle connector 100 and a plug connector 200 mating with each other. In the following instructions, the receptacle connector 100 is only described as an electrical connector with the plug connector 200 described as a complementary connector. In other way of description, the plug connector 200 also can be described as an electrical connector with the receptacle connector 100 described as a complementary connector. In order to express convenience, hereinafter, when the receptacle connector 100 or the plug connector 200 is separately introduced, a mating end of each is the front end, and a wiring end is the back end.

FIGS. 1-11 illustrate the electrical connector 100, and the electrical connector 100 comprises a first insulative housing 11, a plurality of first contacts 12, a first limiting member 13 assembled to the first insulative housing 11 and a plurality of wires 14 electrically connected with the corresponding first contacts 12.

Figure 9:
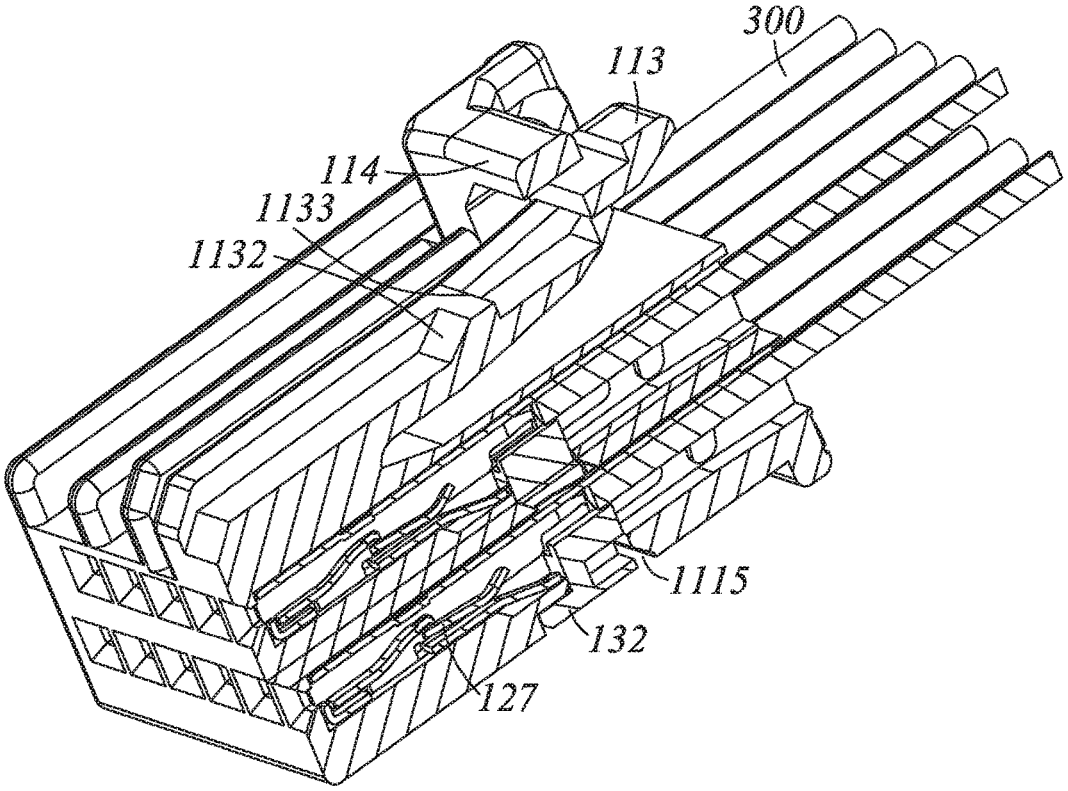
FIG. 9 is a stepped cross-section view taken along line 9-9 of FIG. 2.
Figure 10:
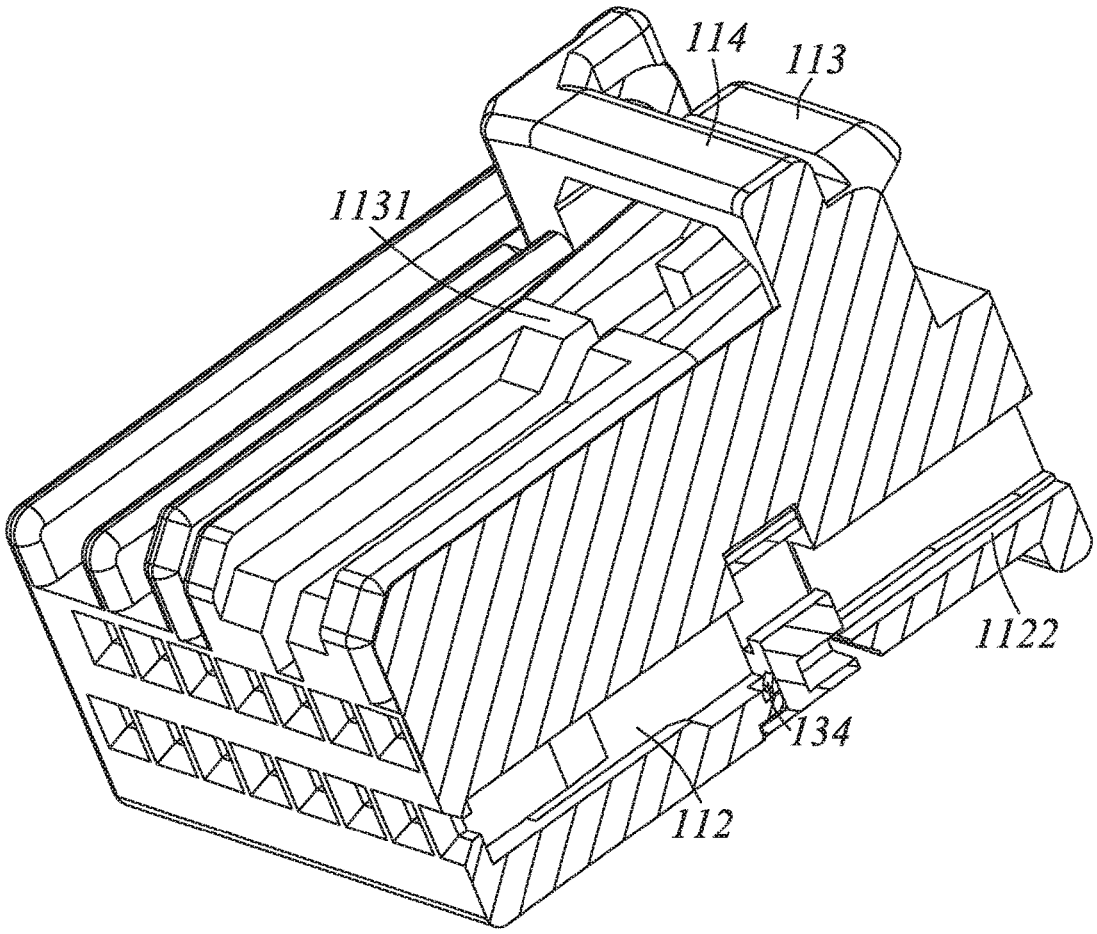
FIG. 10 is a cross-section view of FIG. 2 when the contacts and wires removed away.
Figure 11:
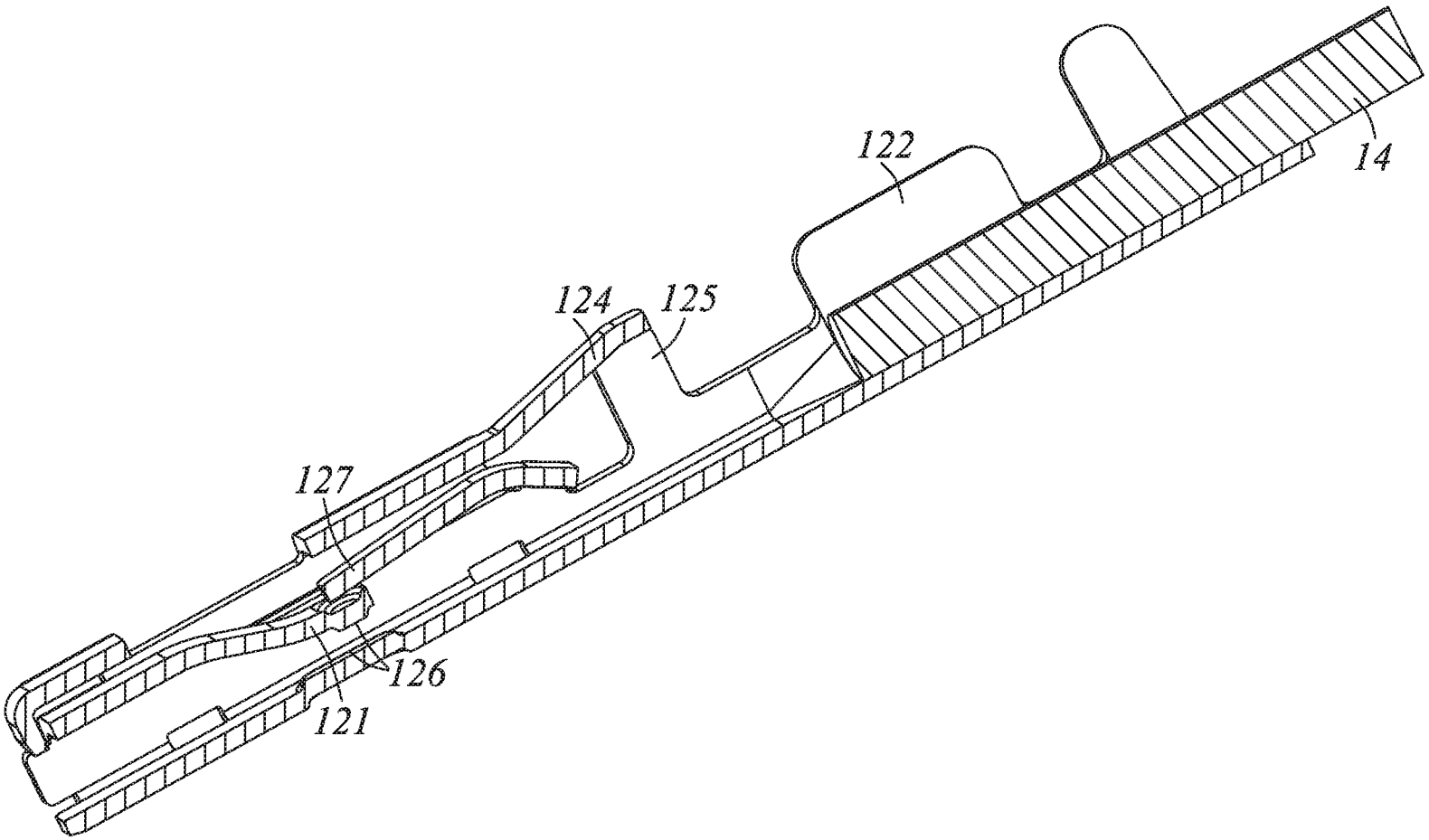
FIG. 11 is a cross-section view of FIG. 6.
Figure 12:
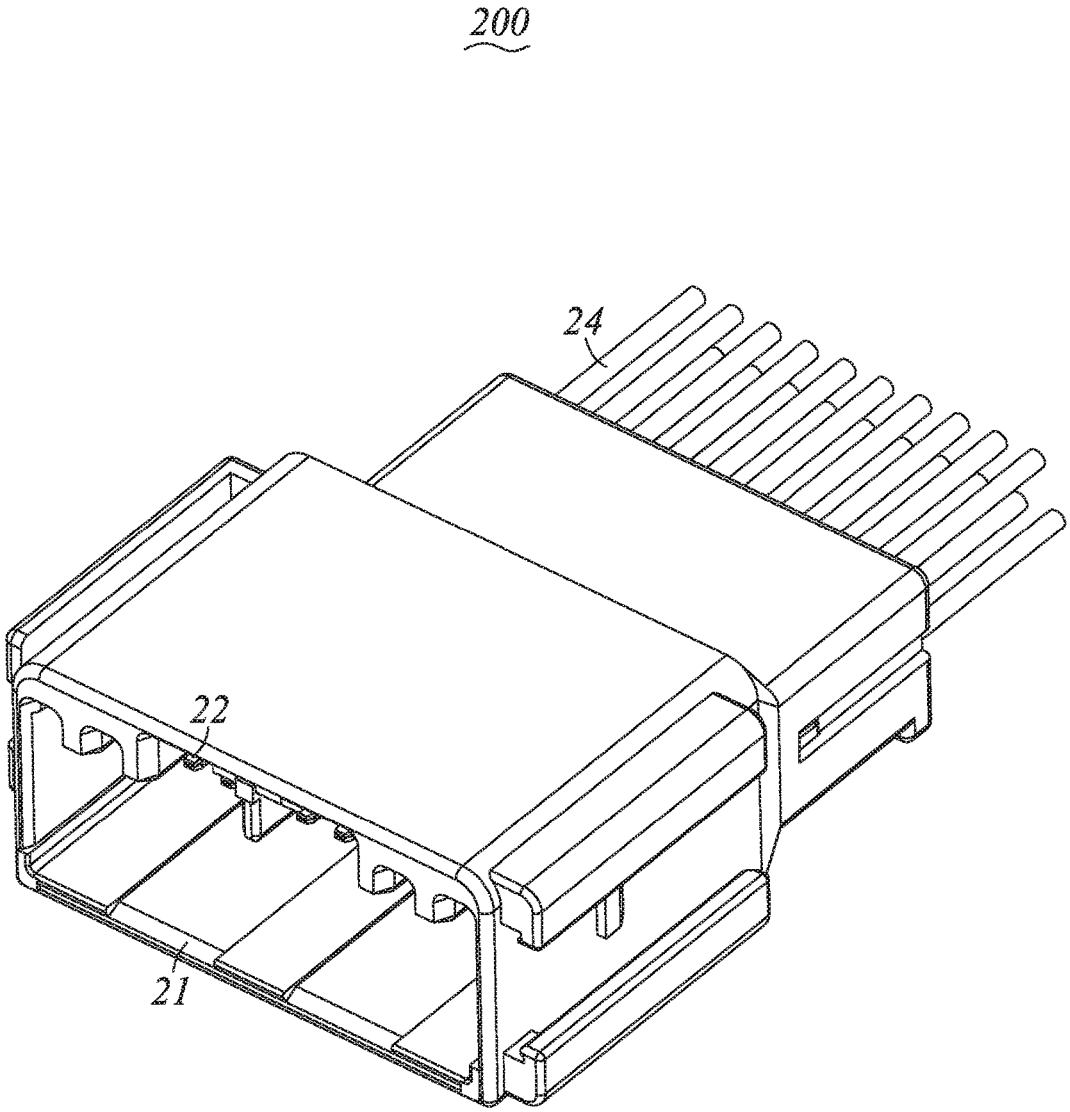
FIG. 12 is a perspective view of a plug connector of the electrical connector assembly shown in FIG. 1.
Figure 13:
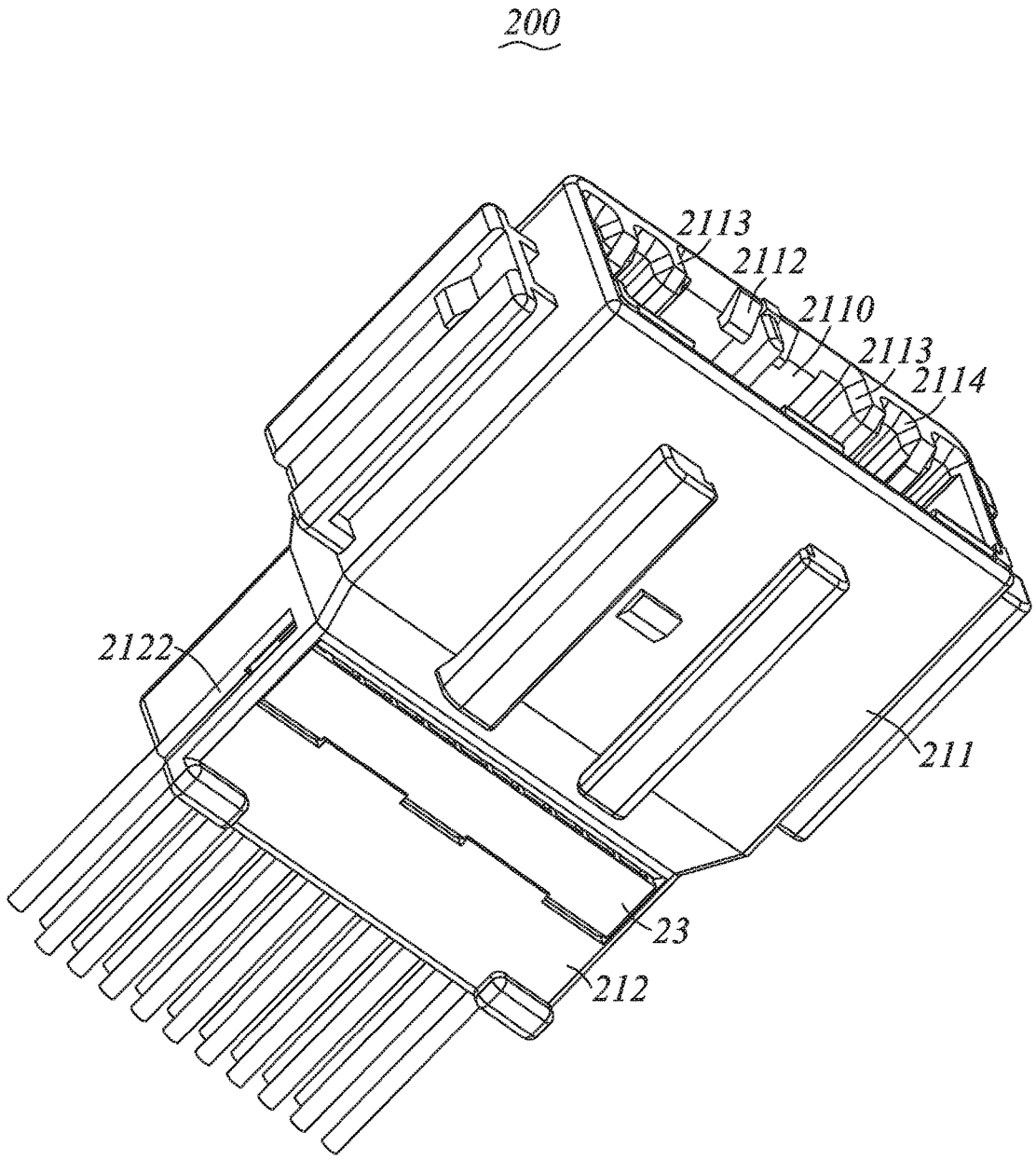
FIG. 13 is similar to FIG. 12, but viewed from a different angle.
Figure 14:
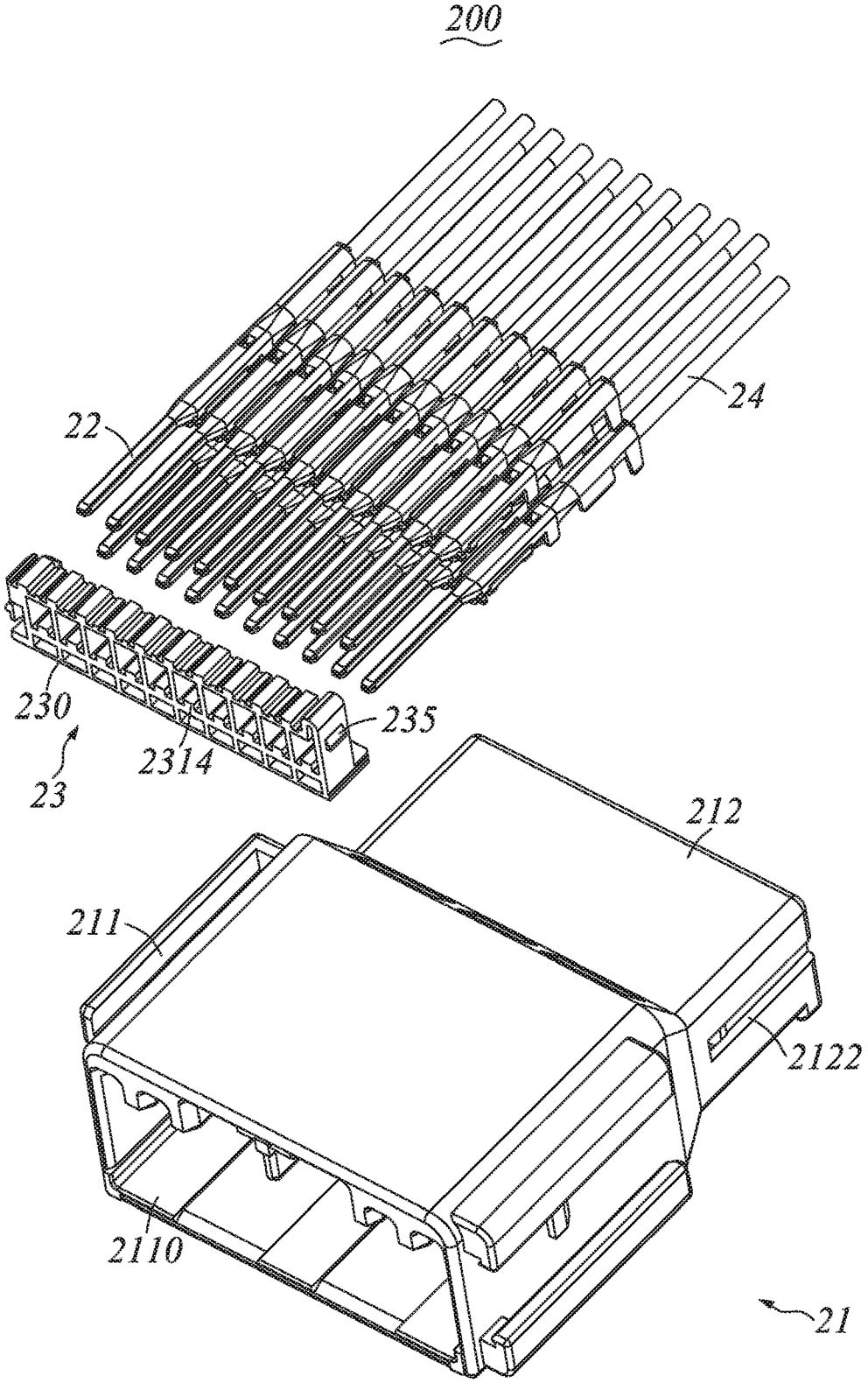
FIG. 14 is an exploded view of the plug connector shown in FIG. 12.
Figure 15:
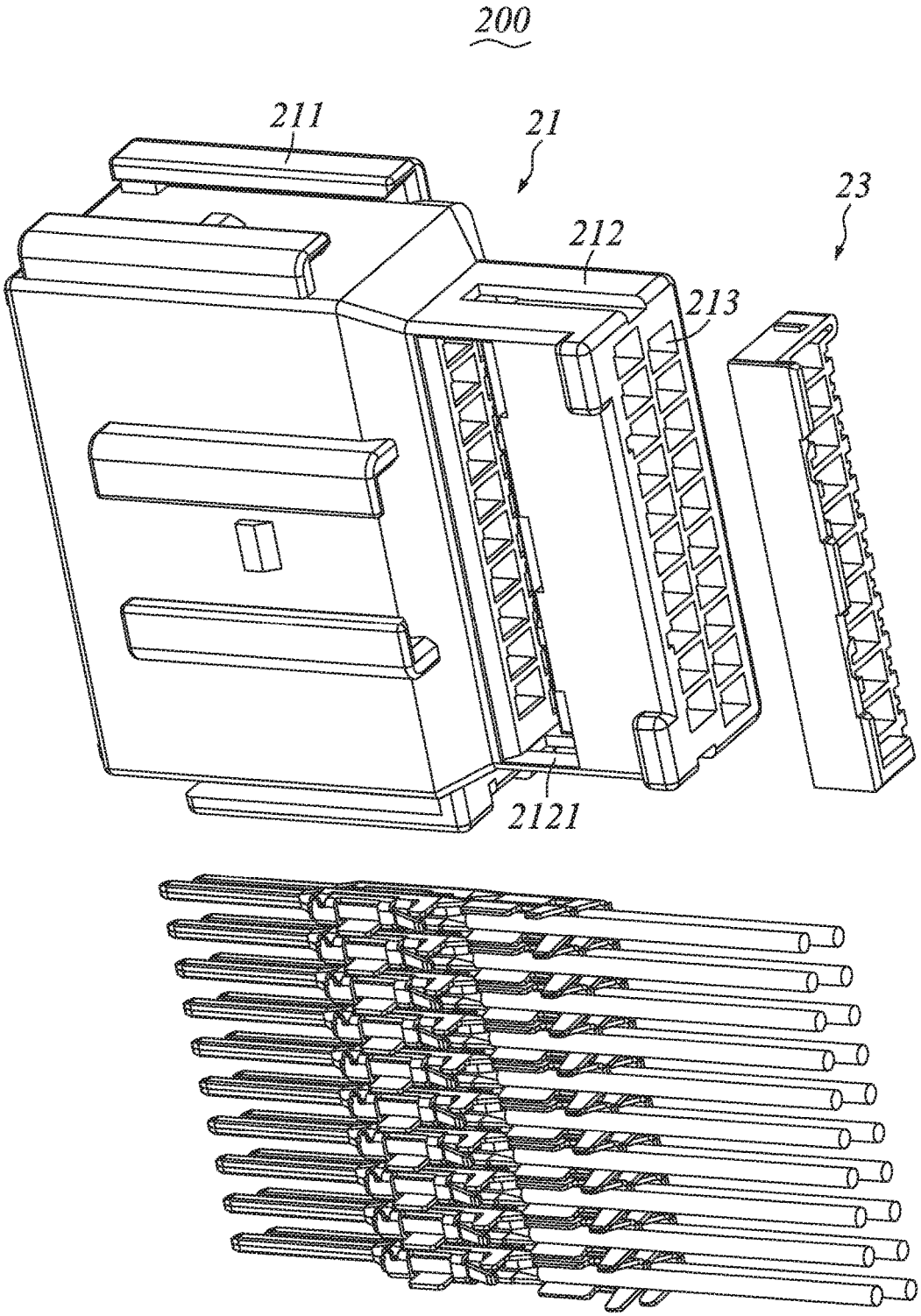
FIG. 15 is similar to FIG. 14, but viewed from a different angle.
Figure 16:
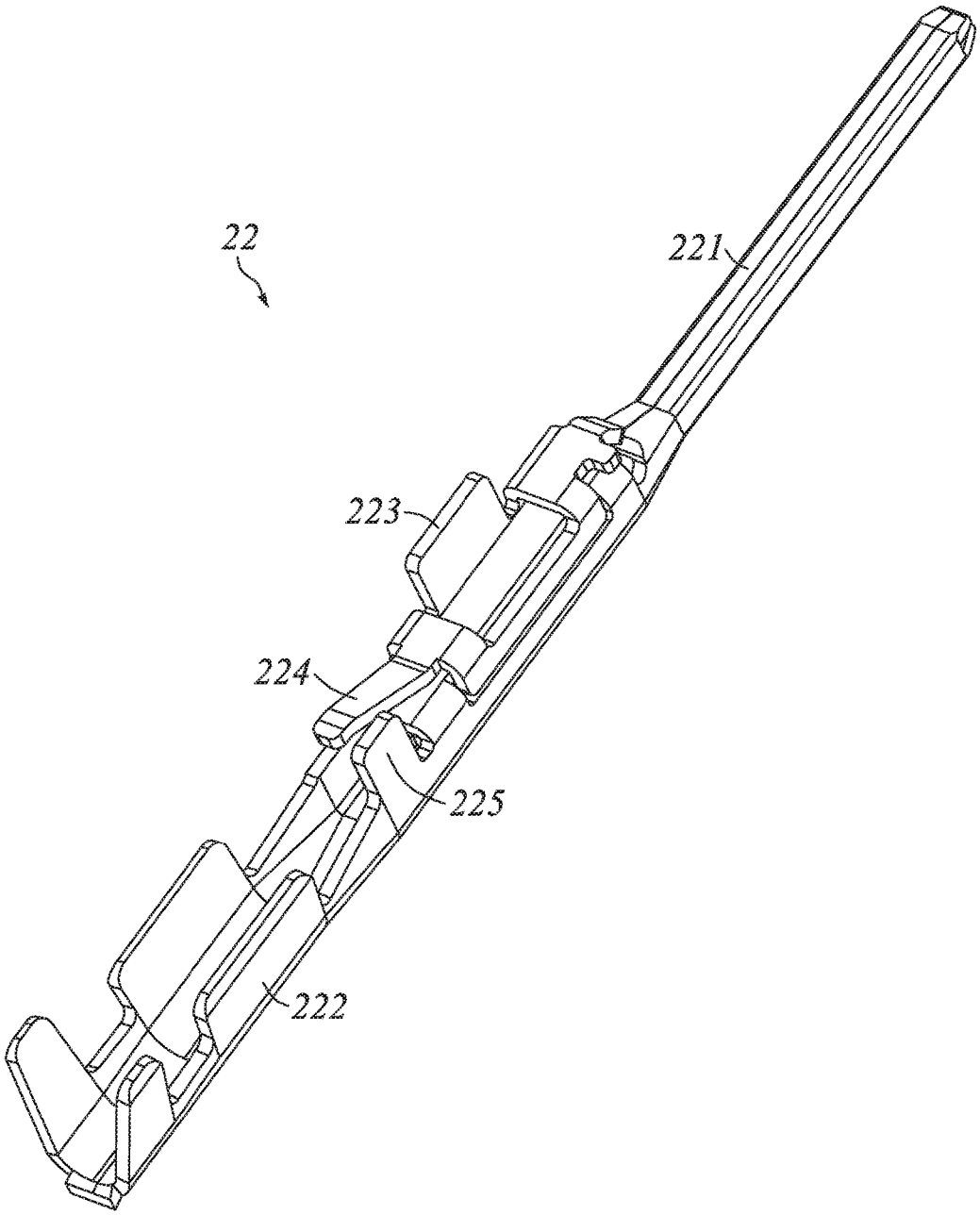
FIG. 16 is a perspective view of a second contact of the plug connector shown in FIG. 14.

Referring to FIGS. 2-5, and conjunction with FIGS. 9-10, the first insulative housing 11 comprises a first main portion 111, a plurality of first contact-receiving passageways 112 extending through the first main portion 111 along a front-and-back direction, and a latching arm 113 protruding from an upper surface of the first main portion 111. Each first contact-receiving passageway 112 is extending from a mating surface 1110 of the first main portion 111 to a rear surface of the first insulative housing 11, in the present embodiment, the first insulative housing 11 has two rows of first contact-receiving passageways 112 along a height direction, and the two rows of first contact-receiving passageways 112 are staggered along a transverse direction. The latching arm 113 is slantly extending backwards and upwards to form a lifted free end in the rear.

Figure 3:
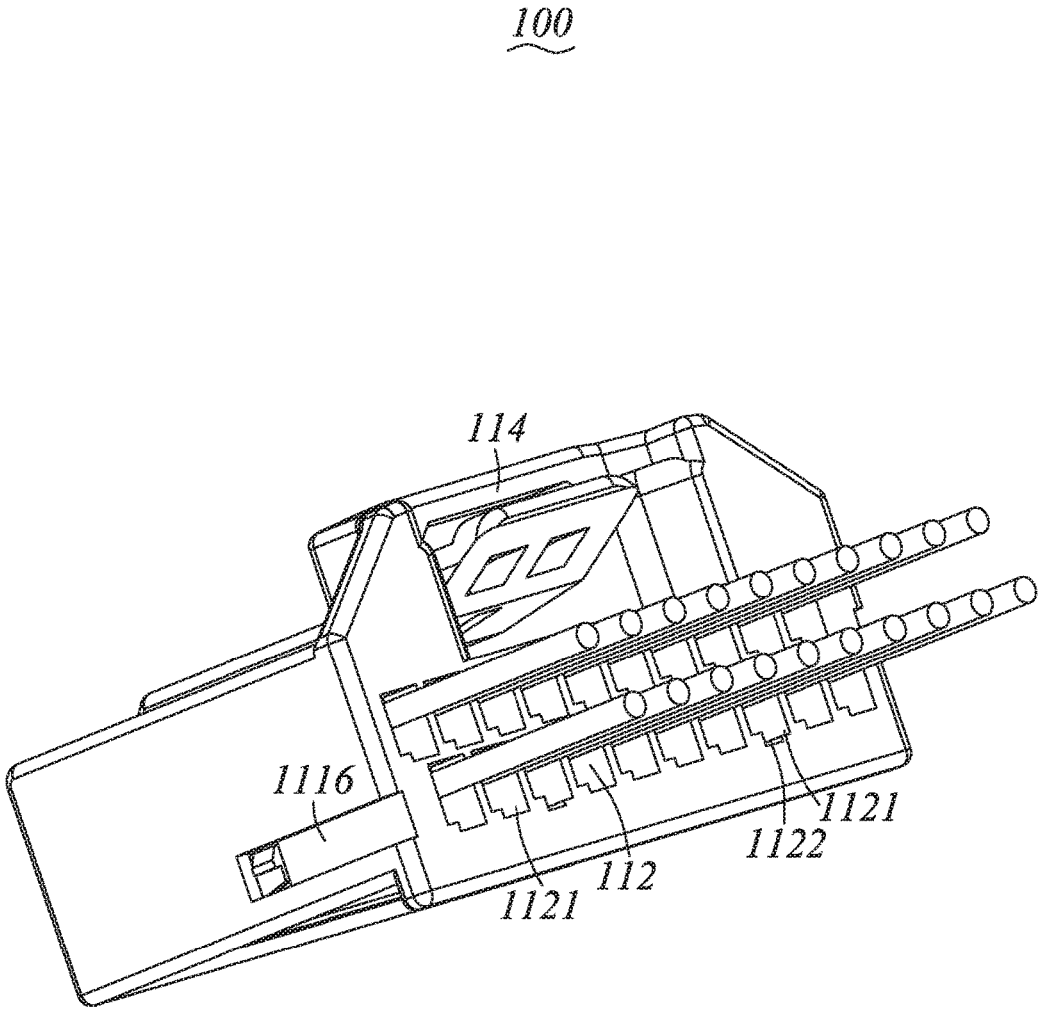
FIG. 3 is similar to FIG. 2, but shown from different aspects.
Figure 4:
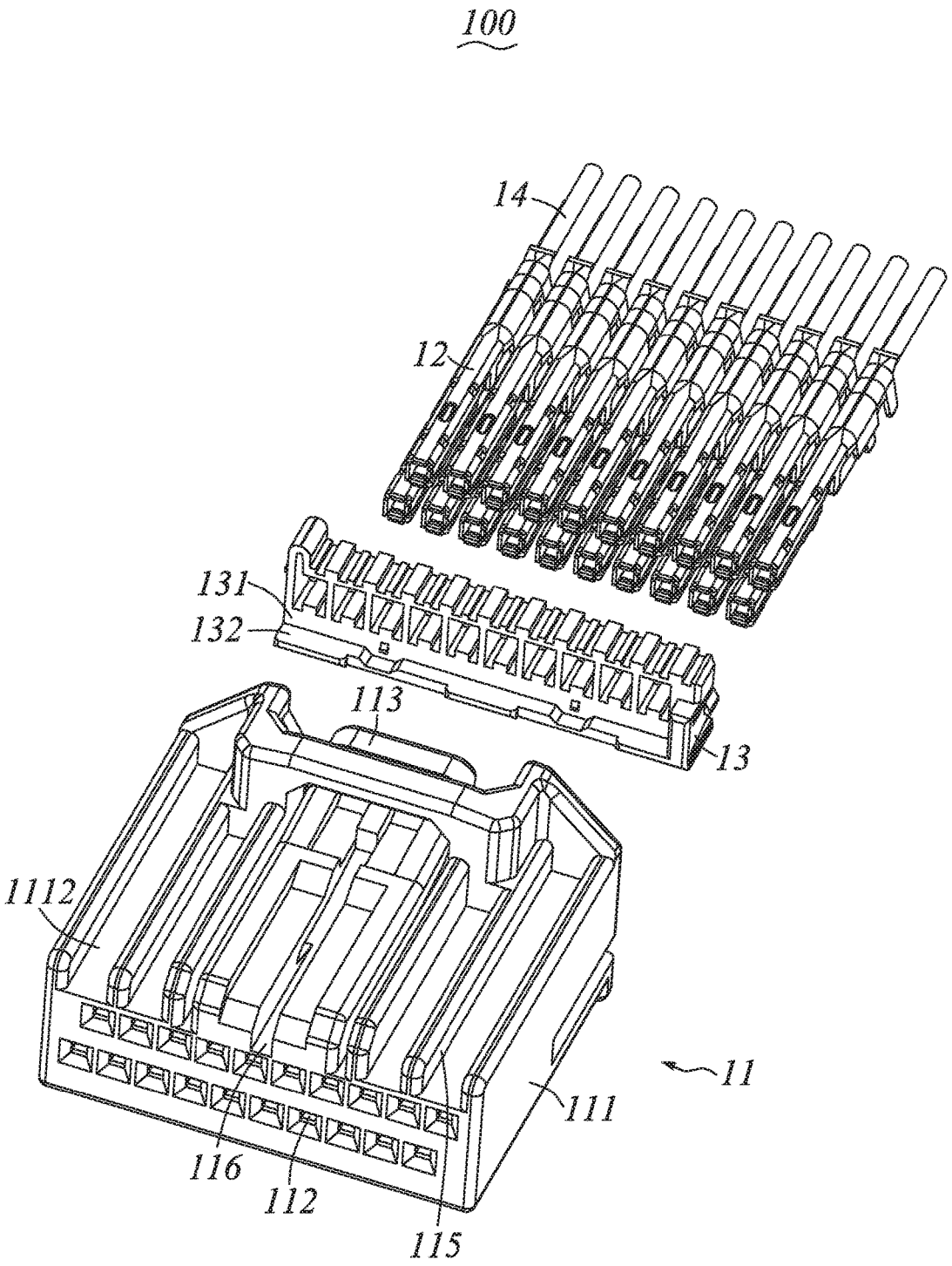
FIG. 4 is an exploded perspective view of the receptacle connector shown in FIG. 2.
Figure 5:
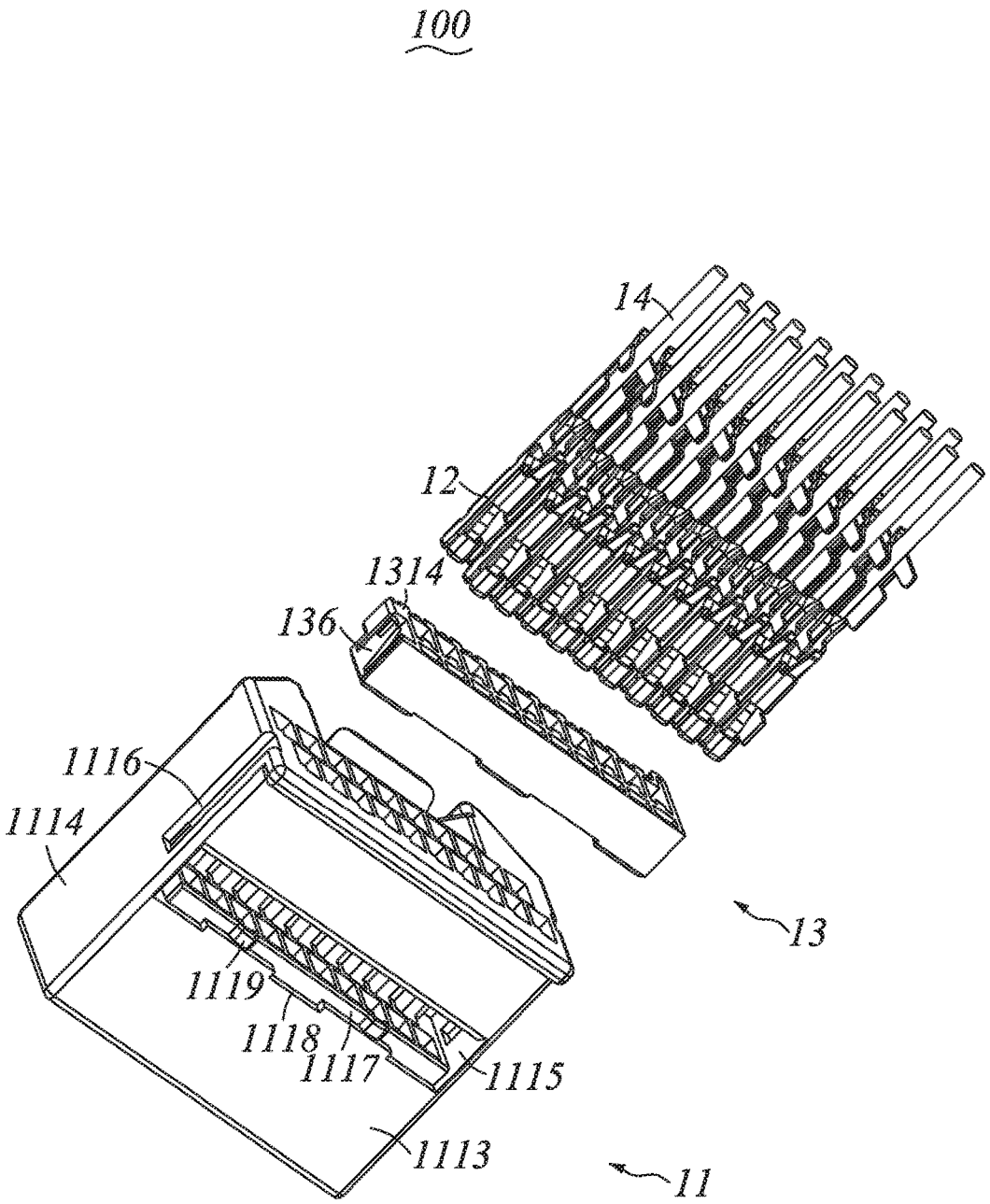
FIG. 5 is similar to FIG. 4, but viewed from a different angle.
Figure 6:
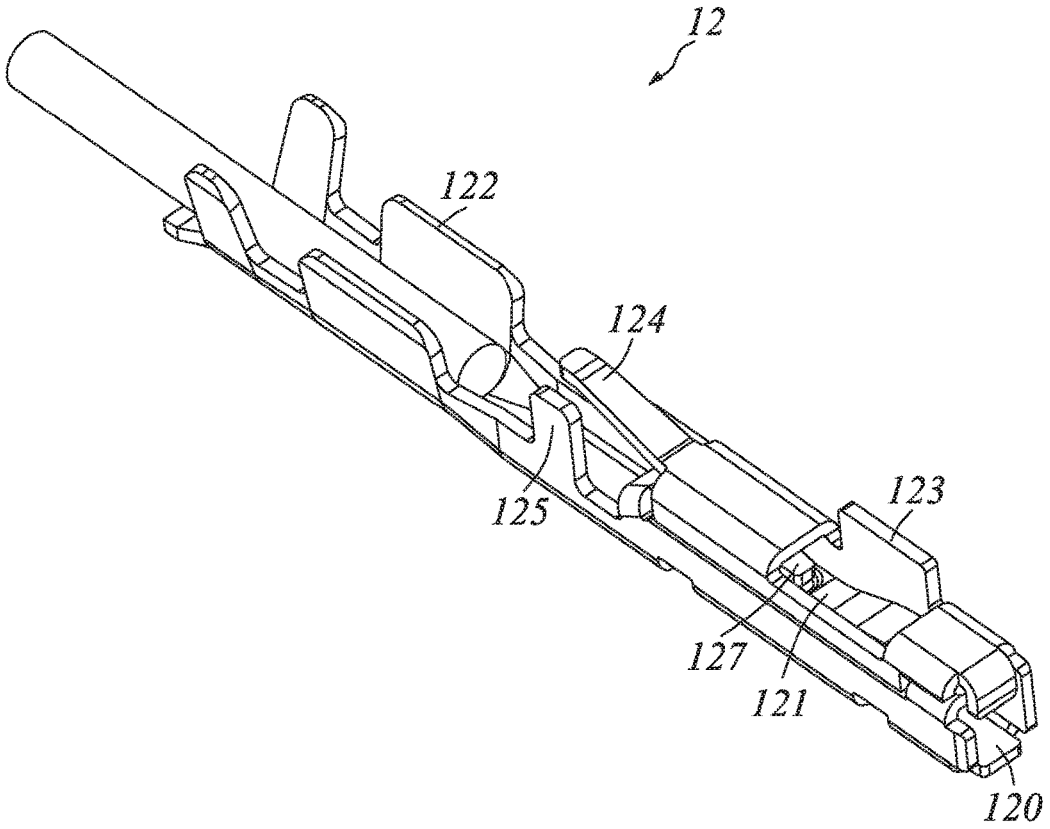
FIG. 6 is a perspective view of a first contact connected with a wire of the receptacle connector shown in FIG. 4.
Figure 7:
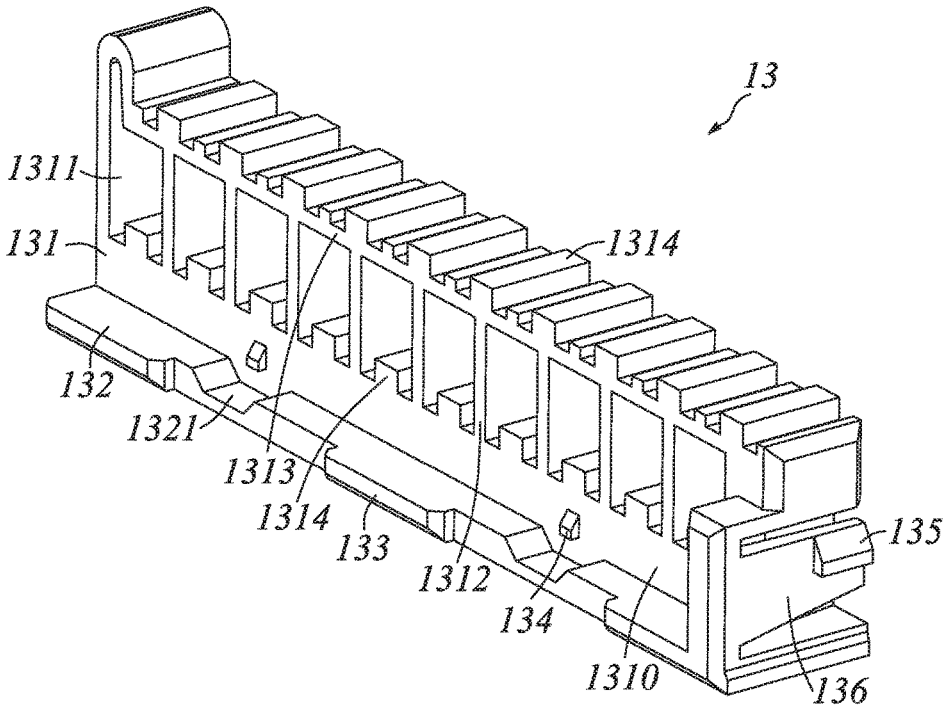
FIG. 7 is a perspective view of a first limiting member of the receptacle connector shown in FIG. 4.
Figure 8:
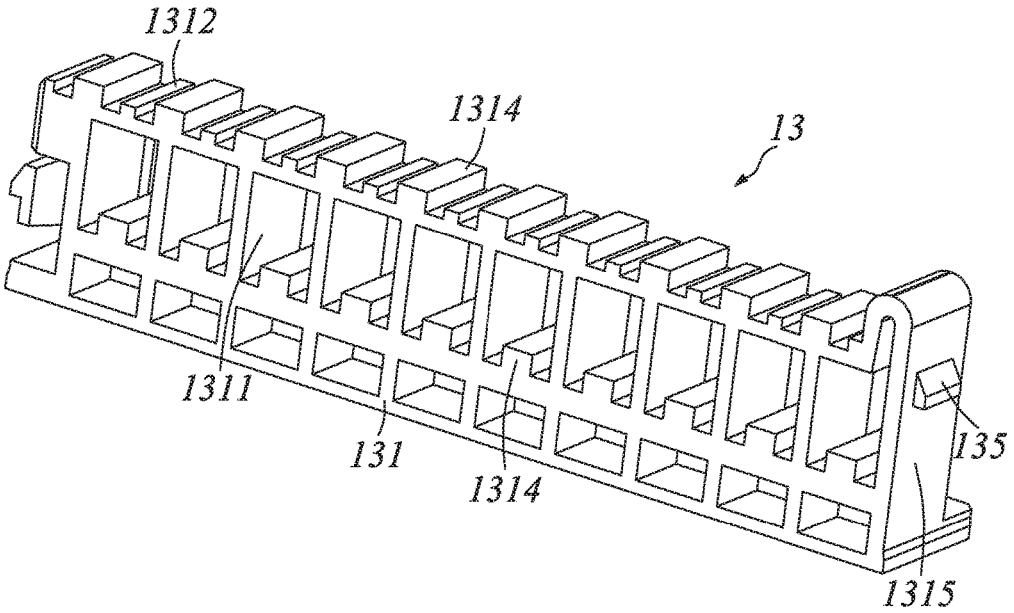
FIG. 8 is similar to FIG. 7, but viewed from a different angle.

Viewed from the rear surface of the first insulative housing 11, each first contact-receiving passageway 112 has an insertion slot 1121 with an increased height, and the insertion slot 1121 is defined on one side of the first contact-receiving passageway 112 along the transverse direction, and extending towards the opposite side. Furthermore, the insertion slots 1121 extend along the transverse direction with unlimited widths, as shown in FIG. 3, each of some first contact-receiving passageways 112 in the lower row also has a deepening portion 1122, and the deepening portion 1122 is arranged adjacent to the relative insertion slot 1121 with a larger height than the insertion slot 1121.

The first insulative housing 11 also has a beam 114 on a top side thereof, the beam 114 is extending along the transverse direction, and located above the latching arm 113. The beam 114 is next to a rear end of the latching arm 113 (as shown in FIG. 9), during the electrical connector 100 plugged into or detached from the complementary connector 200, the beam 114 can prevent the latching arm 113 from overpressure and overturning.

The first main portion 111 has a top wall 1112, a bottom wall 1113 opposite to the top wall 1112, and a pair of side walls 1114 connected the top wall 1112 and the bottom wall 1113. The first main portion 111 also defines a positioning slot 1115 on one side thereof along a height direction, specifically in the bottom wall 1113 thereof, and the positioning slot 1115 extends along the transverse direction. An engaging slot 1116 is arranged in each side wall 1114, and the engaging slot 1116 is recessed inwardly from an exterior surface of the relative side wall 1114 until running through the side wall 1114, each engaging slot 1116 is communicated with the positioning slot 1115. The positioning slot 1115 is recessed upwards from a lower surface of the bottom wall 1113, and communicated with the first contact-receiving passageways 112. Furthermore, the two engaging slots 1116 on both sides of the first insulative housing 11 are discordant along the height direction.

The first main portion 111 also defines a matching groove 1117 and at least one extrusion groove 1118 in the bottom wall 1113 and recessed upwards, the extrusion groove 1118 is located in front of and communicated with the matching groove 1117, and the matching groove 1117 is located in front of and communicated with the positioning slot 1115. Along the height direction, the matching groove 1117 has a smaller height than the positioning slot 1115. At least one convex portion 1119 is protruding downwards in the matching groove 1117.

The first insulative housing 11 also has a latching portion 1131 defined on the latching arm 113, a guiding surface 1132 is defined on a front side of the latching portion 1131 and slantly extending backwards, a latching surface 1133 is defined on a rear side of the latching portion 1131 for locking with the complementary connector 200. The first insulative housing 11 also defines at least one aligning rib 115 and/or one aligning slot 116 on an upper side thereof and opposite to the positioning slot 1115. In the present embodiment, a plurality of aligning ribs 115 are extruding upwards from the top wall 1112 of the first main portion 111, and each aligning rib 115 extends along the front-and-back direction. Two neighboring aligning ribs 115 are spaced apart from each other along the transverse direction to form one aligning slot 116. In other embodiments, the aligning slot 116 also can be recessed downwards from the top wall 1112.

The first contacts 12 are inserted into the corresponding first contact-receiving passageways 112 along a rear-to-front direction, and include at least one row arranged along a transverse direction. In present embodiment as shown, the first contacts 12 are arranged in two rows along the height direction, and a plurality of first contacts 12 in a same row are arranged in the transverse direction. In other embodiment, the first contacts 12 also can be arranged in three rows or more along the height direction.

Each first contact 12 has a front inserting opening 120 for a complementary contact 22 plugging into, and also defines a contacting arm 121 contacting with the complementary contact 22, a crimping portion 122 connected with the relative wire 14, a limiting plate 123 extending along the height direction, an elastic arm 124 extending towards the crimping portion 122 and a stopping plate 125 located on one side of the elastic arm 124. The limiting plate 123 is defined on one side of the first contact 12 along the transverse direction, and inserted into the insertion slot 1121. In addition, the limiting plate 123 and the stopping plate 125 are extending in a same direction, and located on opposite sides of the first contact 12 along the transverse direction, the limiting plate 123 is in front of the stopping plate 125 along the front-and-back direction.

The contacting arm 121 has a front section connected with a side portion of the first contact 12 and a rear section being of a free end, and the rear section inclines upward further, thus to form an elastic contact of the contacting arm 121. One contacting portion 126 is formed upwards on the contacting arm 121 and neighboring to the rear free end of the contacting arm 121. And another contacting portion 126 is defined on an interior side of an upper wall of the first contact 12, and protruding towards the rear free end of the contacting arm 121. The two contacting portions 126 are protruding in opposite direction, to form a reliable double-sided contact with the complementary contact 22, and then increase the reliability of electrical connection as mating.

Each first contact 12 also has an elastic supporting arm 127 connected with a same side portion of the first contact 12 as the contacting arm 121. A front free end of the supporting arm 127 is located below the contacting portion 126 of the contacting arm 121, and the supporting arm 127 is connected with the side portion of the first contact 12 with a rear section. As the complementary contact 22 engaging with the contacting arm 121 on an upper side of the contacting arm 121, when the contacting arm 121 pressed by the complementary contact 22, the supporting arm 127 can provide a certain supporting force on a lower side of the contacting portion 126, therefore each one complementary contact 22 can be sandwiched by two contacting portions 126 of the relative first contact 12 with an enhanced clamping force, thereby to achieve a reliable electrical connection.

The first limiting member 13 is received and engaged with the positioning slot 1115 for locking the plurality of first contacts 12 simultaneously. The first limiting member 13 comprises a base portion 131, an extension portion 132 extending forwardly from a lower segment of the base portion 131, at least one protrusion 133 extending forwardly from a front end of the extension portion 132 and at least one bump 134 protruding forwardly from a front surface of the base portion 131. At least one concave portion 1321 is recessed downwards from an upper surface of the extension portion 132. Any one of the protrusion 133, the concave portion 1321 and the bump 134 can be served as a fastening mechanism matching with the first insulative housing 11. That is to say, the first limiting member 13 has at least one fastening mechanism engaging with the first insulative housing 11. In present embodiment as shown, the first limiting member 13 has a plurality of protrusions 133 spaced from each other, a pair of concave portions 1321 and a pair of bumps 134.

When the first limiting member 13 assembled to the first insulative housing 11, the extension portion 132 is accommodated in the matching groove 1117, the protrusions 133 are received in the relative extrusion grooves 1118, the convex portions 1119 are received in the concave portions 1321, and the bumps 134 are retained in the deepening portion 1122 (as shown in FIG. 10), in this way, to form a reliable orientation between the first limiting member 13 and bottom wall 1113 of the first insulative housing 11.

The base portion 131 defines a plurality of receiving slots 1311 extending through thereof along the front-and-back direction, and the receiving slots 1131 are arranged in at least one row along the transverse direction. In the present embodiment, the first limiting member 13 has two rows of receiving slots 1131 along a height direction, and the two rows of receiving slots 1131 are staggered along a transverse direction. Every two neighboring receiving slots 1131 in a same row are separated from each other by a partition 1312, and the two rows of the receiving slots 1131 are spaced apart from each other by a transverse wall 1313. The partitions 1312 in different rows are extending along the insertion direction of the first limiting member 13 with different heights, furthermore, the partitions 1312 in the upper row extend with a smaller distance than the partitions 1312 in the lower row.

Each receiving slot 1131 has a boss 1314 therein, and the boss 1314 is protruding along the insertion direction of the first limiting member 13. In the preferring embodiment, the first limiting member 13 is assembled to the first insulative housing 11 along a down-to-up direction, the bosses 1314 are protruding upwards. The partitions 1312 in the upper row are extending upwards with a smaller height than the bosses 1314 in the upper row, and the partitions 1312 in the lower row are extending upwards with a larger height than the bosses 1314 in the lower row.

The first limiting member 13 defines a pair of fasteners 135 on both sides thereof along the transverse direction, and the fasteners 135 are asymmetric. Specifically, the first limiting member 13 defines a cantilever 136 on one lateral side thereof, and the cantilever 136 is extending backwards, and one fastener 135 is extruding outwards on a rear end of an external surface of the cantilever 136. As a front end of the cantilever 136 connected with the base portion 131 with a rear end of the cantilever 136 suspended, the fastener 135 on the cantilever 136 can has elasticity. The first limiting member 13 has a vertical wall 1315 on other lateral side, and the other fastener 135 is set on an external surface of the vertical wall 1315.

When the first limiting member 13 incompletely assembled into the positioning slot 1115 along the height direction and the fasteners 135 sliding into the relative engaging slot 1116, the first contacts 12 are inserted into the corresponding first contact-receiving passageways 112 along the front-and-back direction to form a pre-position provided by the first limiting member 13. The elastic arm 124 of the first contact 12 is extending slantly and a free end of the elastic arm 124 is abutting against a front surface of the boss 1314 to form the pre-position.

After the first contacts 12 assembled into the relative first contact-receiving passageways 112 along the front-and-back direction completely, the first limiting member 13 is completely assembled into the positioning slot 1115 along an insertion direction thereof, a back end of the stopping plate 125 is abutting against to a stopping surface 1310 of the first limiting member 13 to form a secondary positioning, in the present embodiment, the stopping surface 1310 is of a front surface of the base portion 131.

FIGS. 12-18 illustrate the plug connector 200 of present invention, and the plug connector 200 comprises a second insulative housing 21, a plurality of second contacts 22 assembled into the second insulative housing 21, a second limiting member 23 assembled to the second insulative housing 21 and a plurality of wires 24 electrically connected with the second contacts 22.

The second insulative housing 21 comprises a second main portion 211, a combined portion 212 extending backwards from a rear end of the second main portion 211, and a plurality of second contact-receiving passageways 213 extending through the second main portion 211 and the combined portion 212 along the front-and-back direction. The second main portion 211 has a receiving cavity 2110 and a locking tab 2112 on an interior side of a top wall of the second main portion 211 for locking with the receptacle connector 100. In addition, similar to the first insulative housing 11, the second main portion 211 has at least one aligning rib 2113 and/or one aligning slot 2114 on the interior side of the top wall thereof, and opposite to the positioning slot 2121. The aligning rib 2113 and the aligning slot 2114 of the plug connector 200 are assorted with the aligning slot 116 and the aligning rib 115 respectively.

Similar to the electrical connector 100, the second insulative housing 21 defines a positioning slot 2121 on one side thereof along a height direction, specifically in a bottom wall of the combined portion 212, and the positioning slot 2121 extends along the transverse direction and is next to the second main portion 211. The second limiting member 23 is received and engaged with the positioning slot 2121 for locking the plurality of second contacts 22 simultaneously.

Similar to the first insulative housing 11, the combined portion 212 of the second insulative housing 21 defines a pair of engaging slot 2122 arranged in both side walls thereof, and each engaging slot 2122 is recessed inwardly from an exterior surface of the relative side wall until running through the side wall, each engaging slot 2122 is communicated with the positioning slot 2121 and locking with a fastener 235 of the second limiting member 23. Furthermore, the two engaging slots 2122 on both sides of the second insulative housing 21 are discordant along the height direction.

Figure 17:
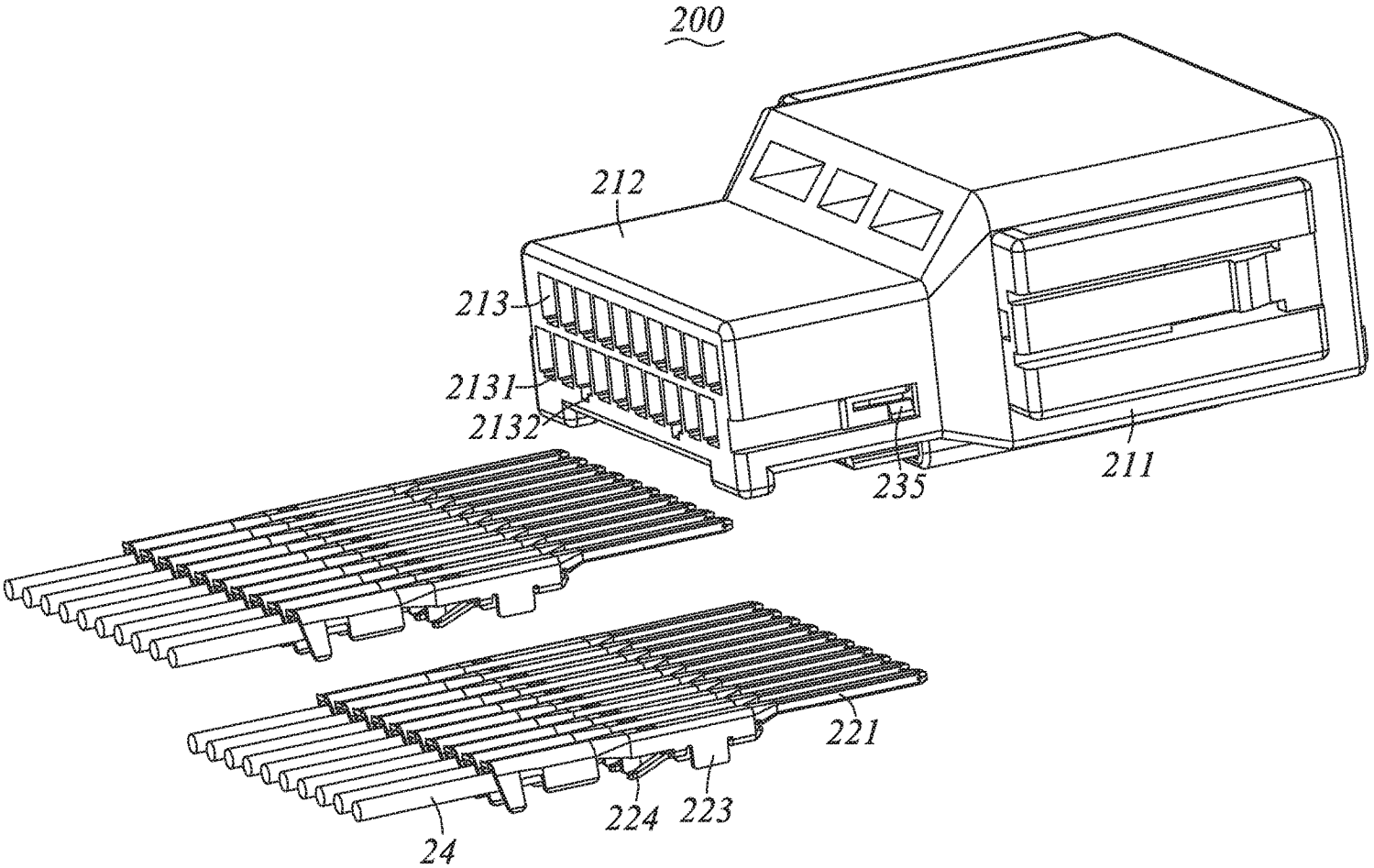
FIG. 17 is a perspective view of the plug connector shown in FIG. 14 when a second limiting member not completely inserted into a second insulative housing and the second contacts not inserted into the second insulative housing.
Figure 18:
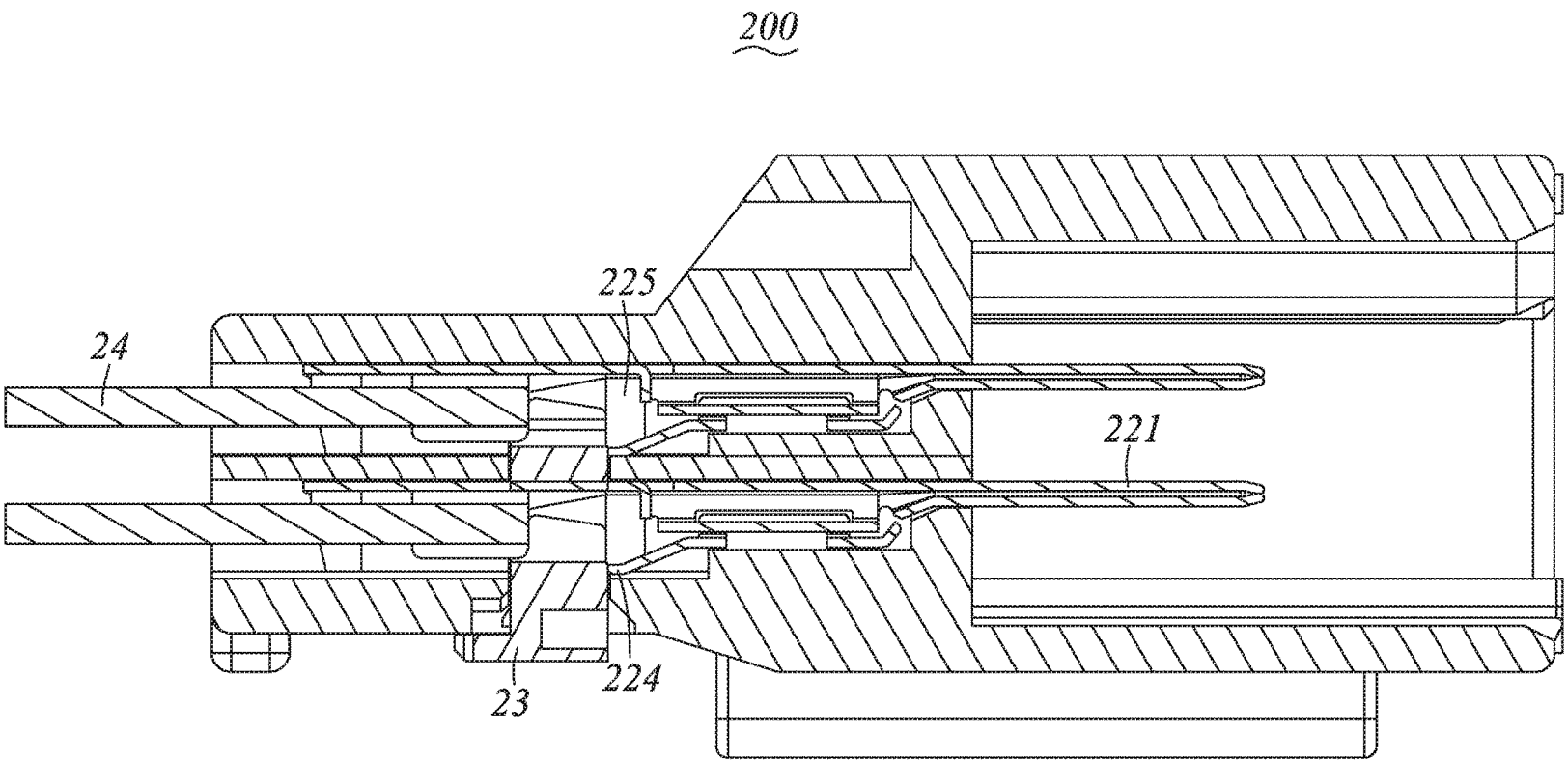
FIG. 18 is a cross-section view of the plug connector shown in FIG. 17 when the second limiting member not completely inserted into the second insulative housing and the second contacts partially inserted into the second insulative housing.

Similar to the first contact-receiving passageway 112, each second contact-receiving passageway 213 has an insertion slot 2131 with an increased height, and the insertion slot 2131 is defined on one side of the second contact-receiving passageway 213 along the transverse direction, and extending towards the opposite side. Furthermore, the insertion slots 2131 extend along the transverse direction with unlimited widths, as shown in FIG. 17, each of some second contact-receiving passageways 213 in the lower row also has a deepening portion 2132, and the deepening portion 2132 is arranged adjacent to the relative insertion slot 2131 with a larger height than the insertion slot 2131.

The second contacts 22 are assembled into the corresponding second contact-receiving passageways 213 in the back-to-front direction, and each second contact 22 has a contacting pin 221 contacting with the first contact 12, a crimping portion 222 connected with the relative wire 24 and a limiting plate 223 extending along the height direction. The limiting plate 223 is defined on one side of the second contact 22 along the transverse direction, and inserted into the insertion slot 2131. Each second contact 22 also has an elastic arm 224 extending towards the crimping portion 222 and a stopping plate 225 located on one side of the elastic arm 224 along the transverse direction.

The second limiting member 23 has a same configuration as the first limiting member 13, and is interchangeable with the first limiting member 13, so there is no need to detailed describe the structure of the second limiting member 23 here. In present invention, the first limiting member 13 and the second limiting member 23 are located on a same side of the electrical connector assembly, and further located on a lower side of the electrical connector assembly. As shown in FIG. 20, the first limiting member 13 and the second limiting member 23 are consistent on the electrical connector assembly along the front-and-back direction. In other words, in isolation of each one of the receptacle connector 100 and the plug connector 200, the first limiting member 13 and the second limiting member 23 are arranged in the respective insulative housing 11, 21 in reverse order.

Similar to the locking manner of the electrical connector 100, when the second limiting member 23 incompletely assembled into the positioning slot 2121 along the height direction and the fastener 235 sliding into the engaging slot 2122, the second contacts 22 are inserted into the corresponding second contact-receiving passageways 213 along the front-and-back direction to form a pre-position provided by the second limiting member 23. The elastic arm 224 of the second contact 22 is extending slantly and a free end of the elastic arm 224 is abutting against a front surface of the boss 2314 to form the pre-position.

After the second contacts 22 assembled into the corresponding second contact-receiving passageways 213 along the front-and-back direction, the second limiting member 23 is completely inserted into the positioning slot 2121 along an insertion direction thereof to form a secondary positioning, a back end of the stopping plate 225 is abutting against to a stopping surface 230 of the second limiting member 23. Different from the receptacle connector 100, the stopping surface 230 of the second limiting member 23 are opposite to the stopping surface 1310 of the first limiting member 13, in other words, the stopping surface 230 of the plug connector 200 is a back surface of the first limiting member 13 shown in FIG. 8, the second limiting member 23 is placed in the plug connector 200 in reverse direction compared with the first limiting member 13 in the receptacle connector 100. In other embodiment, the placement direction of the second limiting member 23 in the plug connector 200 also can be same as the first limiting member 13.

Additionally, when the second limiting member 23 assembled to the second insulative housing 21, the fastening mechanism of the second limiting member 23 engaging with the second insulative housing 21 is defined on a back side of the second limiting member 23, and also can be defined on a front side certainly.

Please referring to FIGS. 19-20, when the electrical connector 100 mating with the complementary connector 200, the locking tab 2112 is crossed the latching portion 1131 and locking with the latching surface 1133. The contacting pin 221 of the complementary connector 200 are sandwiched between two contacting portions 126 of the electrical connector 100 to form a reliable electrical connection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a plurality of contact-receiving passageways extending through thereof along a front-and-back direction;

a plurality of contacts inserted into the corresponding contact-receiving passageways along a rear-to-front direction, and including at least one row arranged along a transverse direction, each contact defining a contacting part contacting with a complementary contact and a crimping portion connected with a wire; and a limiting member assembled to the insulative housing; wherein the insulative housing defines a positioning slot recessed upwards from a lower surface of a bottom wall thereof, and the positioning slot extends along the transverse direction, the limiting member is inserted and retained in the positioning slot for locking the plurality of contacts simultaneously, each contact has an elastic arm extending slantways and a stopping plate on one side of the elastic arm, the limiting member defines at least one row of receiving slots arranged along the transverse direction, a lug boss is defined in each receiving slot and protruding along an insertion direction of the limiting member, when the limiting member incompletely assembled into the positioning slot along the insertion direction, the contacts are inserted into the corresponding contact-receiving passageways along the front-and-back direction, until a free end of the elastic arm abutting against a front surface of the lug boss to form a pre-position, then the limiting member is pushed into the positioning slot completely, until a back end of the stopping plate abutting against a stopping surface of the limiting member.

2. The electrical connector as claimed in claim 1, wherein the positioning slot is communicated with the contact-receiving passageways.

3. The electrical connector as claimed in claim 2, wherein the limiting member defines a pair of fasteners on both sides thereof along the transverse direction, the insulative housing has a pair of engaging slots on both side walls for locking with the corresponding fastener, when the limiting member incompletely assembled into the positioning slot, the fasteners is sliding into the relative engaging slot.

4. The electrical connector as claimed in claim 1, wherein the limiting member has two rows of the receiving slots along a height direction, and the two rows of receiving slots are staggered along a transverse direction.

5. The electrical connector as claimed in claim 4, wherein every two neighboring receiving slots in a same row are separated from each other by a partition, and the two rows of the receiving slots are spaced apart from each other by a transverse wall, the partitions in different rows are extending along the insertion direction of the limiting member with different heights.

6. The electrical connector as claimed in claim 3, wherein the engaging slot is recessed inwardly from an exterior surface of the relative side wall until running through the side wall, and each engaging slot is communicated with the positioning slot.

7. The electrical connector as claimed in claim 6, wherein the two engaging slots on both sides of the insulative housing are discordant along the height direction.

8. The electrical connector as claimed in claim 6, wherein each contact has a limiting plate extending along the height direction, the limiting plate is defined on one side of the contact along the transverse direction, and inserted into the corresponding side of the contact-receiving passageway.

9. The electrical connector as claimed in claim 3, wherein the limiting member defines a fastening mechanism matching with the insulative housing, and the fastening mechanism is located on at least one side of the limiting member along the front-and-back direction.

10. The electrical connector as claimed in claim 9, wherein the limiting member comprises a base portion and an extension portion extending forwardly from a lower segment of the base portion, the fastening mechanism is located on a same side of the base portion as the extension portion.

11. The electrical connector as claimed in claim 10, wherein at least one concave portion is recessed downwards from an upper surface of the extension portion, and the insulative housing has at least one convex portion protruding downwards and received in the concave portion.

12. An electrical connector assembly, comprising an electrical connector and a complementary connector mating with each other, each of the electrical connector and the complementary connector having an insulative housing, a plurality of contacts assembled into the insulative housing and a limiting member assembled to the insulative housing, wherein the insulative housing defines a positioning slot on one side thereof along a height direction, and the positioning slot extends along a transverse direction, the limiting member is inserted and retained in the positioning slot for locking the plurality of contacts simultaneously, each contact of the electrical connector and the complementary connector has an elastic arm extending slantways and a stopping plate on one side of the elastic arm, the limiting member defines at least one row of receiving slots arranged along the transverse direction, a lug boss is defined in each receiving slot and protruding along an insertion direction of the limiting member, when the limiting member incompletely assembled into the positioning slot along the insertion direction, the contacts are inserted into the corresponding contact-receiving passageways along the front-and-back direction, until a free end of the elastic arm abutting against a front surface of the lug boss to form a pre-position, then the limiting member is pushed into the positioning slot completely, until a back end of the stopping plate abutting against a stopping surface of the limiting member.

13. The electrical connector assembly as claimed in claim 12, wherein the limiting members of the electrical connector and the complementary connector have a same configuration, and are located on a same side of the electrical connector assembly.

14. The electrical connector assembly as claimed in claim 13, wherein the limiting members of the electrical connector and the complementary connector are interchangeable with each other.

15. The electrical connector as claimed in claim 13, wherein the positioning slot is recessed upwards from a lower surface of a bottom wall of the insulative housing, and communicated with contact-receiving passageways formed in the insulative housing.

16. The electrical connector assembly as claimed in claim 15, wherein the limiting member defines a pair of fasteners on both sides thereof along the transverse direction, the insulative housing has a pair of engaging slots on both side walls for locking with the corresponding fastener, when the limiting member incompletely assembled into the positioning slot along the height direction, the fasteners are sliding into the relative engaging slots.

* * * * *